US008517507B2

(12) United States Patent
Hayashi

(10) Patent No.: US 8,517,507 B2
(45) Date of Patent: Aug. 27, 2013

(54) FLUID EJECTING APPARATUS

(75) Inventor: Takato Hayashi, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 406 days.

(21) Appl. No.: 13/025,525

(22) Filed: Feb. 11, 2011

(65) Prior Publication Data

US 2011/0199419 A1 Aug. 18, 2011

(30) Foreign Application Priority Data

Feb. 12, 2010 (JP) ..... 2010-028879

(51) Int. Cl.
*B41J 2/165* (2006.01)

(52) U.S. Cl.
USPC ..... 347/31

(58) Field of Classification Search
CPC ..... B41J 2/16508
USPC ..... 347/19, 22, 23, 29, 31, 32
See application file for complete search history.

(56) References Cited

U.S. PATENT DOCUMENTS 5,557,307 A * 9/1996 Paroff ..... 347/34
7,562,961 B2 7/2009 Inoue
7,819,499 B2 * 10/2010 Sakurai ..... 347/31
2010/0118084 A1 5/2010 Seshimo

FOREIGN PATENT DOCUMENTS

JP 2005-119284 5/2005

* cited by examiner

*Primary Examiner* — An Do
(74) *Attorney, Agent, or Firm* — Workman Nydegger

(57) ABSTRACT

A fluid ejecting apparatus that has a nozzle row provided with a plurality of nozzles and a fluid ejection head ejecting a fluid from the nozzle row is provided. The fluid ejecting apparatus includes a linear absorption member that is provided movable and is extended along the nozzle row, and a traveling mechanism that causes the absorption member to move. The traveling mechanism includes a delivery rotating body that drives out the absorption member, a winding-rotating body that winds up the absorption member, a tension regulating member that applies a predetermined tension to the absorption member and is displaced according to the tension of the absorption member, and a sensor portion that detects the displacement of the tension regulating member and controls rotations of the delivery rotating body and the winding-rotating body.

11 Claims, 9 Drawing Sheets

FLUID EJECTING APPARATUS

The entire disclosure of Japanese Patent Application No. 2010-28879, filed Feb. 12, 2010 is expressly incorporated by reference herein.

BACKGROUND

1. Technical Field

The present invention relates to a fluid ejecting apparatus.

2. Related Art

Generally, as a fluid ejecting apparatus which ejects ink droplet to a recording paper (medium), an ink jet type printer (hereinafter, refer to a "printer") is widely known. In such a printer, there is problem in which clogging of the nozzle by a thickening of viscosity or the solidification of ink through vaporizing of ink from a nozzle of the recording head, adherence of dust, mixing of air bubbles, and the like, occurs, thus a printing failure is caused. Therefore, in the printer, a flushing operation in which ink within a nozzle is forcibly discharged is performed, aside from ejecting ink to the recording paper.

Typically, in a scanning type printer, the flushing operation may be performed in a state where the recording head is moved to an area other than a recording area. However, in a printer having a line head in which the recording head is fixed, the recording head cannot move when the flushing operation is performed. Therefore, for example, a method, in which ink is discharged toward an absorbing material (an absorption member) installed on a surface of a transporting belt for transporting the recording paper, was considered (refer to JP-A-2005-119284).

However, in JP-A-2005-119284, since a plurality of absorbing material is disposed on the transporting belt at a regular intervals according to the size of the recording paper, ink must be ejected at the space between the recording papers when the flushing operation is performed, and there is a problem that the size of the recording paper or a transport velocity is limited. Further, when the flushing operation is performed to a planar absorbing material, a mist-phase ink is scattered by the wind pressure according to the discharge of ink droplet, and there is concern that the recording paper or the transporting belt is likely to be contaminated.

Therefore, it is considered that a linear absorption member is used as the absorbing material, in which the linear absorption member (absorbing material) is disposed between the line head and the recording paper (recording medium), and ink may be received in the absorption member by ejecting and flushing ink toward the absorption member. In that case, since the amount of ink receivable in the absorption member is limited, moving the absorption member after receiving ink to some extent, performing flushing toward a new area of the absorption member, and again receiving ink is considered.

However, in the case where the absorption member is moved, tension thereof becomes unstable, and for example slackness is generated. Thus, vibration occurs due to the slackness, the area received with ink becomes contact with the head or the recording paper, and there is concern that the head or the recording paper may become contaminated. Also, if the absorption member is moved more than necessary, there is concern that the use efficiency of the absorption member may be lowered.

SUMMARY

An advantage of some aspects of the invention is that, it provides a liquid ejecting apparatus which prevents a head and a recording medium (recording paper) from being contaminated by improving stabilization of tension in a case in which a linear absorption member is used as an absorption member receiving liquid and moved and prevents lowering of use efficiency of the absorption member.

According to an aspect of the invention, there is a fluid ejecting apparatus which has a nozzle row provided with a plurality of nozzles and a fluid ejection head that ejects a fluid from the nozzle row, the fluid ejecting apparatus includes, a linear absorption member that is extended along the nozzle row and is disposed to be movable from one side of the nozzle row toward the other side of the nozzle row, and the linear absorption member absorbs fluid ejected from the nozzle; and a traveling mechanism that causes the absorption member to travel from the one side of the nozzle row toward the other side, and the traveling mechanism includes: a delivery (transmitting) rotating body that drives out (sends) the absorption member by unwinding the absorption member from a state where the absorption member is wound up; a delivery driving portion that rotates the delivery rotating body; a winding-rotating body that winds up the absorption member that is driven out from the delivery rotating body; a winding-driving portion that rotates the winding-rotating body; a tension regulating member that applies a predetermined tension to the absorption member and is displaced according to the tension of the absorption member; and a sensor portion that detects the displacement of the tension regulating member and controls the delivery driving portion and/or the winding-driving portion so that the displacement of the tension regulating member is within a predetermined range.

According to the fluid ejecting apparatus, due to the fact that the absorption member has a predetermined tension applied by the tension regulating member, the absorption member, which is stopped between the delivery rotating body and the winding-rotating body, can be held in a stable condition with the predetermined tension. Also, even when the absorption member is moved by the traveling mechanism, since the displacement of the tension regulating member is detected by the sensor portion, and the delivery driving portion and/or the winding-driving portion is controlled so that the displacement of the tension regulating member is within the predetermined range, the displacement of the tension regulating member is within the predetermined range by controlling the delivery driving portion or the winding-driving portion, thus, the tension of the traveling absorption member which is travelling also may be stabilized.

Further, in the fluid ejecting apparatus, the tension regulating member may be constructed so that the tension regulating member reaches a first position if the absorption member is equal to or more than a first tension and is separated from the first position if the absorption member is less than the first tension, and the tension regulating member may be constructed so that the tension regulating member reaches a second position if the absorption member is equal to or less than a second tension which is weaker than the first tension, wherein the sensor portion may include a first sensor that stops the winding-driving portion if the tension regulating member reaches the first position and drives the winding-driving portion if the tension regulating member is separated from the first position, and a second sensor that drives the winding-driving portion and stops the delivery driving portion if the tension regulating member reaches the second position.

According to the above described construction, since the winding-rotating body is stopped if the absorption member is equal to or more than the first tension and the tension regulating member reaches the first position, the delivery rotating body also is stopped at the above state, and the absorption member becomes stopping state without traveling. When the delivery rotating body is rotated from the above state, since the amount of the absorption member unwound, which is unwound between the delivery rotating body and the winding-rotating body, increases and the tension weakens and becomes lower than the first tension, the tension regulating member is separated from the first position. Accordingly, the first sensor detects whether the tension regulating member reaches the first position or not this and drives the winding-driving portion. Therefore, due to the fact that the delivery rotating body and the winding-driving portion are driven with together, the tension of the absorption member is stabilized, and the displacement of the tension regulating member also is held within the predetermined range.

Moreover, when the tension of the absorption member becomes further weaker and is equal to or less than the second tension, the tension regulating member reaches the second position. Accordingly, since the second sensor detects whether the tension regulating member reaches the second position or not and drives the winding-driving portion (maintains the driving of the winding-driving portion) along with stopping the delivery driving portion, the amount of the absorption member unwound which is unwound between the delivery rotating body and the winding-rotating body becomes less, and the tension becomes large and is equal to or more than the second tension.

Therefore, if the tension of the absorption member is changed to more than a setting range, the displacement of the tension regulating member also becomes more than the predetermined range, and the driving and stopping of the delivery driving portion and/or the winding-driving portion are controlled automatically. Herewith, due to the fact that the displacement of the tension regulating member is regulated so as to return to within the predetermined range, the tension of the absorption member is stabilized within the predetermined range.

Further, in a state where the tension of the absorption member is equal to or more than the first tension and the tension regulating member is positioned the first position, and in a state where the traveling of absorption member is stopped, if the absorption member is plastically deformed and extended, the tension becomes small and is less than the first tension. Accordingly, as above described, the winding-driving portion is driven since the tension regulating member is separated from the first position. Moreover, the absorption member is wound up to the winding-rotating body so amount as the extended amount. By this, if the tension of absorption member becomes again equal to or more than the first tension, the tension regulating member reaches the first position, and the winding-driving portion is again stopped. Therefore, the tension is held to a stabilized state even though the absorption member is stopped for long periods for example.

Further, in the fluid ejection of the invention, in a state where the tension regulating member is displaced between the first position and the second position, the sensor portion may be provided with a third sensor that detects a displacement amount displaced from a reference position and controls the delivery driving portion and/or the winding-driving portion.

If it is constructed so that not only the driving and/or stopping of the delivery driving portion or the winding-driving portion is simply on-off controlled by the first sensor or the second sensor, but also, for example, the velocity of the rotation of the delivery rotating body or the winding-driving portion is controlled by the third sensor according to the displacement amount of the tension regulating member, the tension of the absorption member can be varied more smoothly. Therefore, it is possible to better prevent the occurrence of vibrations in the absorption member.

Further, in the fluid ejecting apparatus of the invention, the tension regulating member may be installed in the delivery rotating body-side rather than the nozzle row, a rotating body for inspection may be provided, the rotating body for inspection is turned accompanied by traveling of the absorption member along with rotating of the absorption member in the course of the travel path of the absorption member that travels between the delivery rotating body and the tension regulating member, and a detection mechanism may be installed in the rotating body for inspection, the detection mechanism detects the traveling length of the absorption member which rotates the rotating body for inspection by detecting the number of rotations of the rotating body for inspection.

Due to the fact that the number of rotations of the rotating body for inspection is directly proportional to the traveling length of the absorption member, the traveling length (traveling distance) of the absorption member can be surely detected by the detection mechanism. Therefore, the driving out-amount of the absorption member from the delivery rotating body can be surely recognized, it is possible to prevent that an area, which does not absorb the fluid and is transferred to the winding-rotating body, is increased since the absorption member more than necessary is driven out (is traveled), and the lowering of use efficiency of the absorbing member can be prevented.

Further, in the fluid ejecting apparatus of the invention, an identification body may be installed along the circumferential direction of the rotating body for inspection, and the detection mechanism can detects the number of rotations of the rotating body for inspection by detecting the identification body.

According to the above configuration, the number of rotations of the rotating body for inspection can be detected by the simple construction, thus, the traveling length of the absorption member can be detected.

Further, in the fluid ejecting apparatus of the invention, a safety mechanism may be installed, the safety mechanism detects if the tension of the absorption member is equal to or more than a predetermined tension and stops the winding-driving portion.

According to the above configuration, for example, if the remains of the absorption member wound up to the delivery rotating body reaches zero, or if the absorption member is unexpectedly caught up and the tension of the absorption member becomes equal to or more than a predetermined tension, the winding-driving portion is stopped by the safety mechanism, thus, problems such as cutting of the absorption member, and the like are avoided.

Further, the safety mechanism may include a safety lever that is displaced according to the tension of the absorption member and a safety sensor portion, the safety sensor portion detects when the safety lever is displaced and reaches a predetermined position by the tension of the absorption member becoming equal to or more than a predetermined tension, and the safety sensor portion stops the winding-driving portion.

According to the above configuration, problems such as the cutting of the absorption member, and the like are avoided through a simple construction.

Further, in the fluid ejecting apparatus of the invention, after the absorption member is moved from one side of the nozzle row toward the other side of the nozzle row, the absorption member may be constructed so as to extend along a nozzle row different from the nozzle row along with rotating a reversal roller and being directed to the one side again.

According to the above configuration, due to the fact that the delivery rotating body and the winding-rotating body is collectively disposed in the one side of the nozzle row, miniaturization of the fluid ejecting apparatus can be improved. Also, it can be constructed so that the absorption of the fluid ejected is performed for two different nozzle rows by one traveling mechanism.

The reversal roller may be constructed with a plurality of rollers, for which the gaps therebetween are adjustable.

According to the construction, the absorption member, which is directed to the one side once again by adjusting the gaps between the rollers of the plurality of rollers, can be reliably extended along the different nozzle row.

Further, in the fluid ejecting apparatus of the invention, the absorption member may be installed in plural, and the traveling mechanism may be installed in plural according to the number of the absorption member.

According to the construction, when the fluid ejecting head has a plurality of nozzle rows, for example the absorption member respectively corresponds to the plurality of nozzle rows, and the each absorption members can be controlled by the independent traveling mechanism.

Further, in the fluid ejecting apparatus, the absorption member may be extended along the nozzle row, and may be relatively movable between the position at which the absorption member absorbs fluid ejected from the nozzle and the position at which the absorption member is removed from the flight path of fluid ejected from the nozzle.

According to the above configuration, as the absorption member is linear, the absorption member can be moved to the removal position from the flight path of fluid with a minimal movement. Therefore, the time for maintenance can be shortened in relation to the flushing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
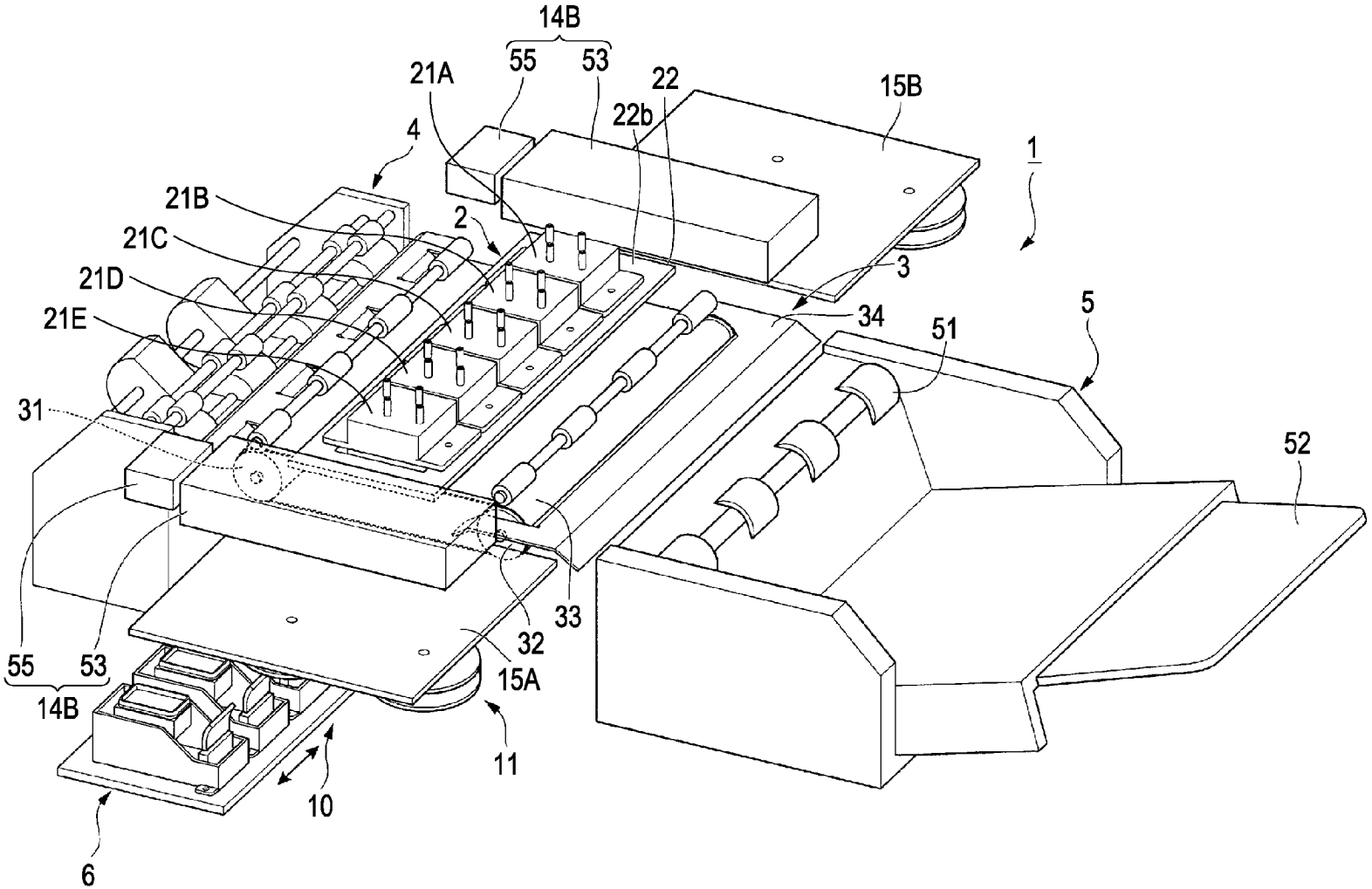
FIG. 1 is a perspective view illustrating a schematic structure of a print of a first embodiment.

Hereinafter, a first embodiment of fluid ejecting apparatus of the invention is described with reference to the drawings. Further, in the drawings used in the following description, so as to make the size of each member recognizable, the scale of each member is changed appropriately.

In the embodiment, an ink jet printer (hereinafter, simply refer to a "printer") is exemplified as the fluid ejecting apparatus.

Figure 2:
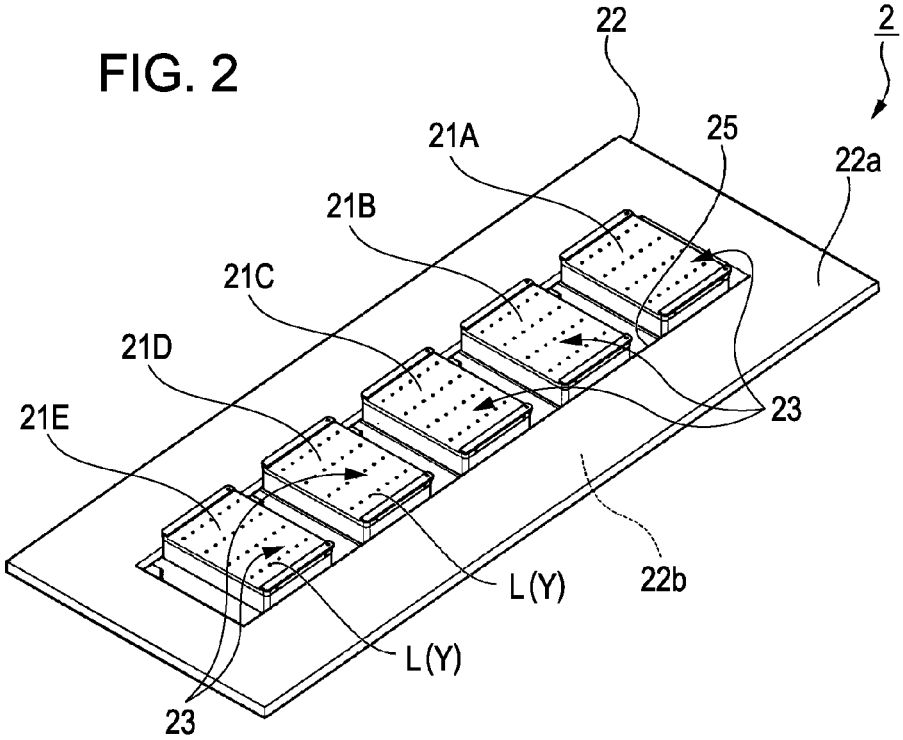
FIG. 2 is a perspective view illustrating a schematic structure of a head unit of the first embodiment.
Figure 3:
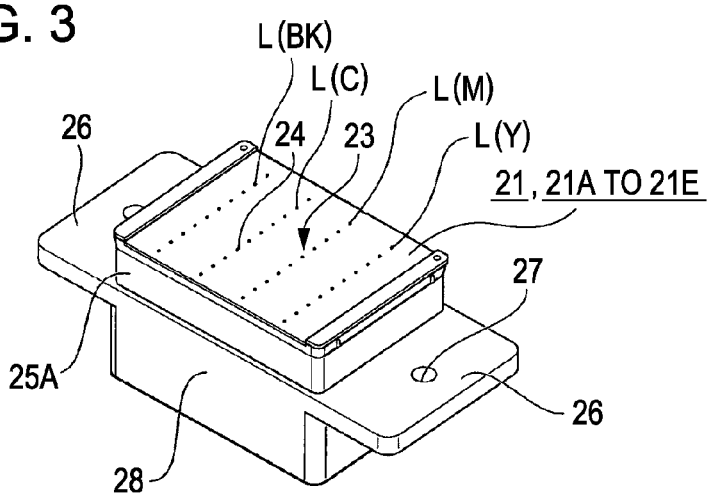
FIG. 3 is a perspective view illustrating a schematic structure of a recording head of the first embodiment.
Figure 4:
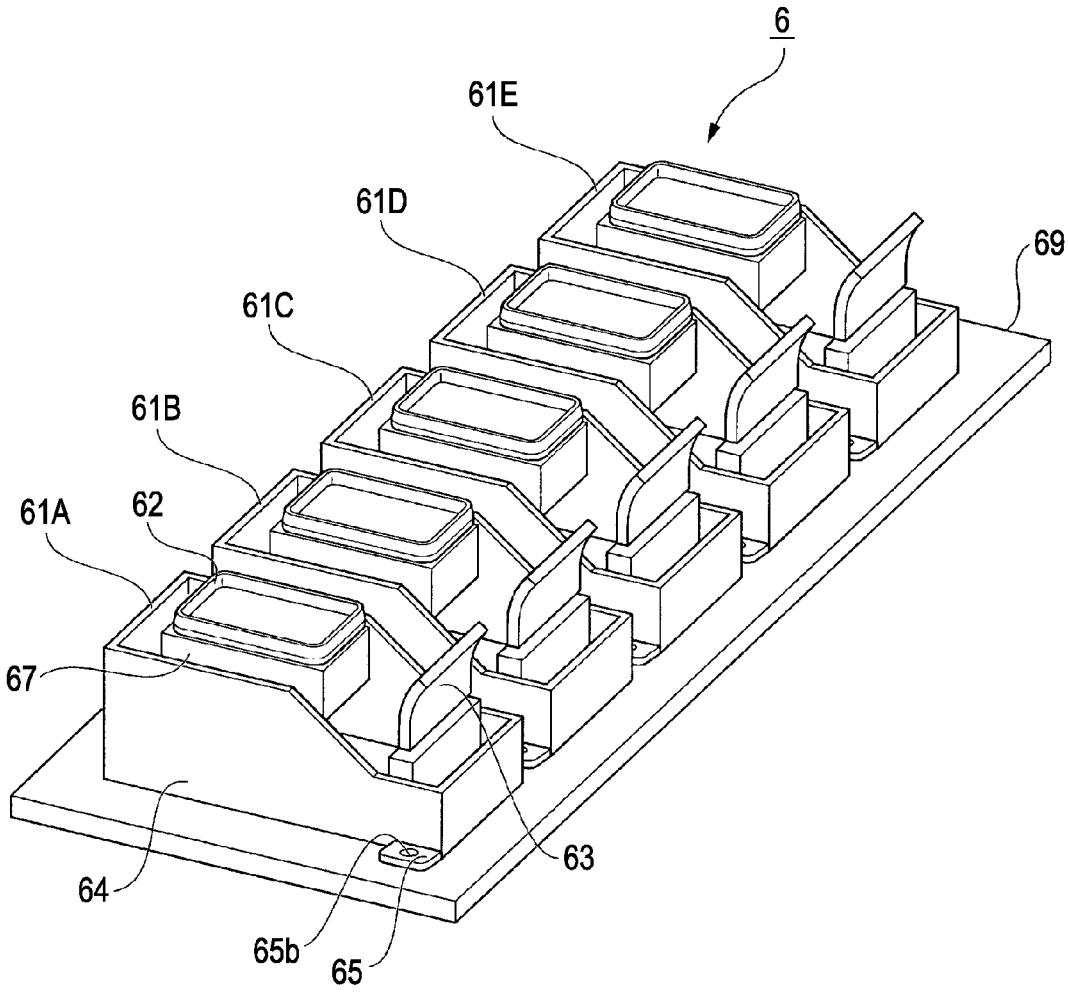
FIG. 4 is a perspective view illustrating a schematic structure of a cap unit of the first embodiment.

FIG. 1 is a perspective view illustrating a schematic structure of the printer, FIG. 2 is a perspective view illustrating a schematic structure of a head unit, FIG. 3 is a perspective view illustrating a schematic structure of a recording head constituting the head unit, and FIG. 4 is a perspective view illustrating a schematic structure of a cap unit.

As illustrated in FIG. 1, the printer 1 includes: the head unit 2, a transport unit 3 that transports a recording paper (a recording medium), a paper-feeding unit 4 that feeds the recording paper, a paper-discharging unit 5 that discharges the recording paper printed by the head unit 2, and a maintenance unit 10 that performs the maintenance processing of the head unit 2.

The transport unit 3 is constituted so that the recording paper is held in a state where there is a predetermined interval between nozzle surfaces 23 of the respective recording heads 21 (21A, 21B, 21C, 21D, 21E) (a fluid ejection head) constituting the head unit 2. The transport unit 3 includes a driving roller portion 31, a driven roller portion 32, and a transport belt portion 33 that includes a plurality of belts suspended and turned between the roller portions 31 and 32. Also, a supporting member 34 is installed to hold the recording paper between the transport unit 3 and the paper discharging unit 5 at the transport direction downward side (the paper discharging unit 5-side) of the recording paper.

An end side of a rotation shaft direction of the driving roller portion 31 is connected to a driving motor (not shown), and the driving roller portion is driven by the driving motor. Also, the rotating force of the driving roller portion 31 is transferred to the transport belt portion 33, and the transport belt portion 33 is rotated. A transmission gear is installed between the driving roller portion 31 and the driving motor if needed. The driven roller portion 32 is a so called free roller, and is rotated according to the rotation of the transport belt portion 33 (the driving roller portion 31) along with supporting the transport belt portion 33.

The paper discharging unit 5 includes a roller 51 for discharging the paper, and a paper discharging tray 52 that holds the recording paper transported by the roller 51 for discharging the paper.

The head unit 2 is unitized by a plurality of (five in the present embodiment) recording heads 21A to 21E, and a plurality of colors of ink (for example, each ink of black B, magenta M, yellow Y, cyan C) is discharged from the respective nozzles 24 (see, FIG. 3) of the respective recording heads 21A to 21E. These recording heads 21A to 21E (hereinafter, sometimes refer to "recording head 21") are attached to an attachment plate 22 and unitized. That is, the head unit 2 according to the embodiment is combined in plural from a plurality of recording heads 21, thus, the effective print width of the head unit 2 is approximately the same as the longitudinal width (the width perpendicular to the transport direction) of the recording paper, and the head unit constitutes a line head module. Also, the respective structures themselves of each recording heads 21A to 21E are common.

As illustrated in FIG. 2, in the head unit 2, each of the recording heads 21A to 21E are disposed in an opening 25 formed at the attachment plate 22. Specifically, the respective recording heads 21A to 21E are screwed to the rear surface 22*b* side of the attachment plate 22, and are disposed in a state where the nozzle surfaces 23 are passed through the opening 25 and protruded from the surface 22*a* side of the attachment plate 22. Moreover, the head unit 2 is mounted to the printer 1 by fixing the attachment plate 22 to a carriage (not shown).

In the embodiment, the head unit 2 is constituted so as to be movable between a recording position and a maintenance position (the direction indicated by the arrow in FIG. 1) by the carriage. Here, the recording position is the position which is opposite to the transport unit 3 and performs the recoding on the recording paper. Meanwhile, the maintenance position is the position which is withdrawn from on the transport unit 3 and is opposite to the maintenance unit 10. In the maintenance position, the maintenance processing (suctioning processing, wiping processing) of the head unit 2 is performed.

As illustrated in FIG. 3, the recording heads 21A to 21E (hereinafter, sometimes simply refer to "recording head 21") constituting the head unit 2 include a head body 25A that has the nozzle surfaces 23 in which nozzle rows L consisting of a plurality of nozzles 24 are formed in multiple rows, and a supporting member 28 in which the head body 25A is attached thereto.

The respective recording heads 21A to 21E include the nozzle rows (L(Y), L(M), L(C), L(BK)) corresponding to the four colors (yellow (Y), magenta (M), cyan (C), black (BK)), therefore, the nozzle rows L are formed to four. In each nozzle row (L(Y), L(M), L(C), L(BK)), the nozzles 24 forming these nozzle rows (L(Y), L(M), L(C), L(BK)) are arranged to the horizontal direction crossing the transport direction of the recording paper. Specifically, the nozzles are arranged to the horizontal direction perpendicular to the transport direction of the recording paper. Moreover, in the respective recording heads 21A to 21E, the respective nozzle rows are disposed so that the nozzle rows L corresponding to the same color in the arrangement of these recording heads 21A to 21E are in a line. Further, in the respective nozzle rows (L(Y), L(M), L(C), L(BK)) of the each recording heads 21A to 21E, a total of eight rows may be formed by two rows for each color. In that case, the two nozzle rows installed for each color may be disposed in a zigzag pattern.

In the supporting member 28, a projecting portion 26 and 26 is formed at both sides in the longitudinal direction of the nozzle surface 23, and a through hole 27 is formed in the projecting portion 26 and 26 so as to screw the recording head 21 to the rear surface 22B of the attachment plate 22. Thus, the plurality of recording heads 21 is attached to the attachment plate 22, and the head unit 2 is constituted (see FIG. 1).

The maintenance unit 10 includes a cap unit 6 which performs the suctioning processing of the head unit 2, and a flushing unit 11 for receiving ink which is discharged by a flushing operation.

As illustrated in FIG. 4, the cap unit 6 performs the maintenance processing of the head unit 2, and is constituted so that a plurality of cap portions 61A to 61E (five in the embodiment) corresponding to the respective recording heads 21A to 21E is unitized. The cap unit 6 is disposed at the position outside the recording area of the head unit 2.

The respective cap portions 61A to 61E (hereinafter, sometimes simply refer to "cap portion 61") are installed corresponding to each of the recording heads 21A to 21E, and are contactable with the nozzle surfaces 23 of the respective recording heads 21A to 21E. The above constructed cap portions 61A to 61E are tightly adhered to the respective nozzle surfaces 23 of the recording heads 21A to 21E, thus, the suctioning operation which discharges ink (fluid) from the nozzles 24 of the respective nozzle surfaces 23 can be performed favorably.

Moreover, the respective cap portions 61A to 61E include: a cap body 67, a seal member 62 that is installed in a frame shape to the upper surface of the cap body 67 and abuts to the recording head 21, an wiping member 63 that is used during wiping processing in which the nozzle surface 23 of the recording head 21 is swept away, and a housing 64 that holds the cap body 67 and the wiping member 63 integrally.

Two supporting portions 65 (one of the two is not shown) are formed in the bottom of the housing 64 so as to hold the housing 64 to a base member 69. The supporting portions 65 are disposed at the positions which are diagonal to the housing 64 in a planar view. In each of the supporting portions 65, through holes 65*b* are formed so as to insert a screw to screw and fix the housing 64 to the base member 69.

Figure 5:
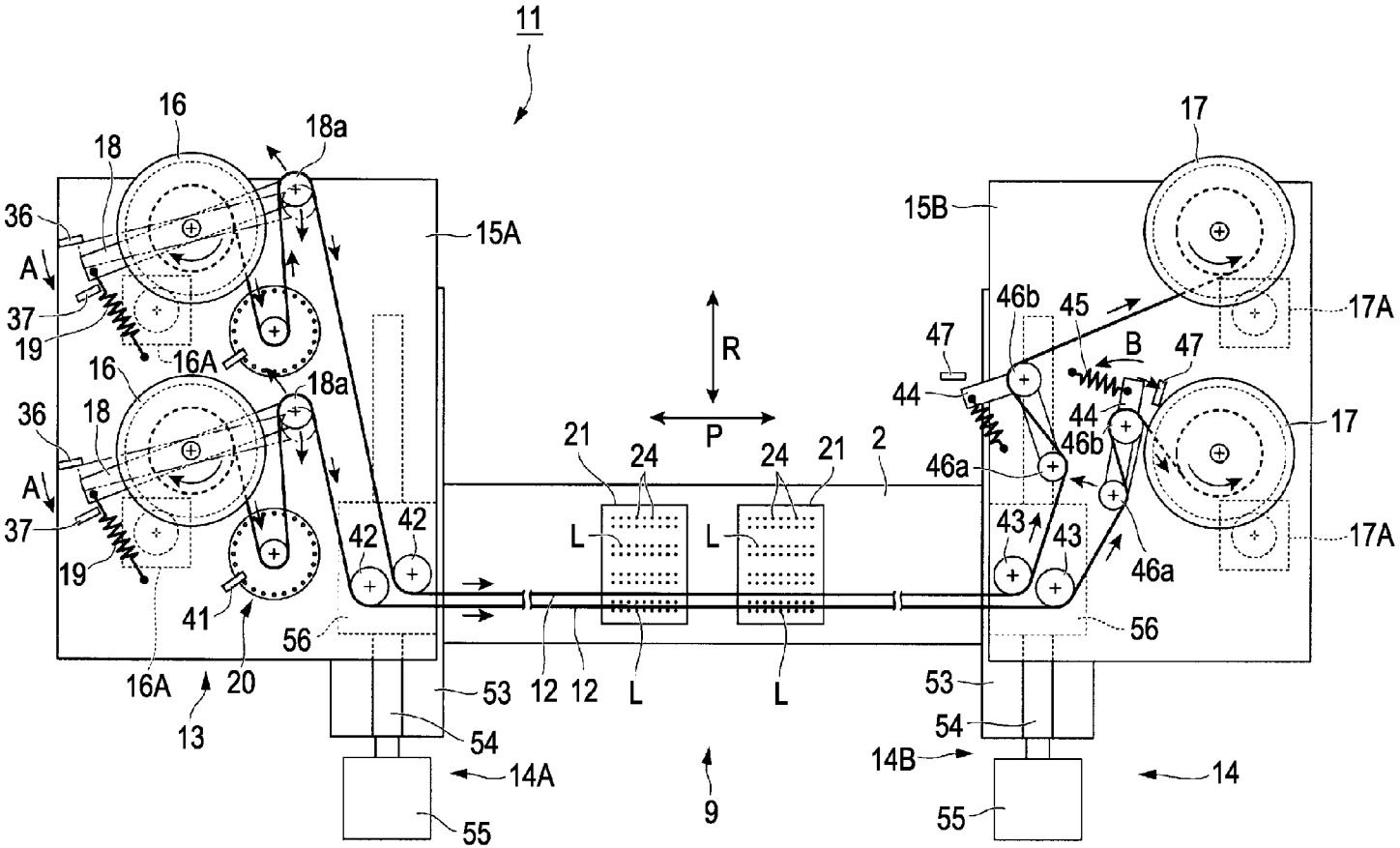
FIG. 5 is a bottom view illustrating a schematic structure of a flushing unit of the first embodiment.

As shown in FIG. 5 illustrating the bottom surface side of the head unit 2, the flushing unit 11 includes an absorption member 12 that absorbs ink droplets (fluid) discharged during the flushing operation, and a supporting mechanism 9 that holds the absorption member 12.

The absorption member 12 absorbs ink droplets discharged from the respective nozzles 24 and is constructed to be linear, and, in the embodiment, two absorption members are installed per each head unit 2. The respective absorption members 12 are disposed to extend along to corresponding nozzle rows (L(Y), L(M), L(C), L(BK)) respectively, and are disposed at between the respective nozzle surfaces 23 and the transport area of the recording paper.

The absorption member 12 may be formed from, for example, a thread material, and the like, and may be suitably used if it can absorb and hold (receive) ink effectively. Specifically, the absorption member 12 may be formed by fibers such as SUS 304, nylon, hydrophilic coated nylon, aramid, silk, cotton, polyester, ultrahigh molecular weight polyethylene, polyarylate, XYRON (trade name), and the like, or complex fiber containing multiple of fibers in combination.

More specifically, the absorption member 12 may be formed by twisting or bundling fiber bundles formed from the fiber or the complex fiber.

Figure 6A:
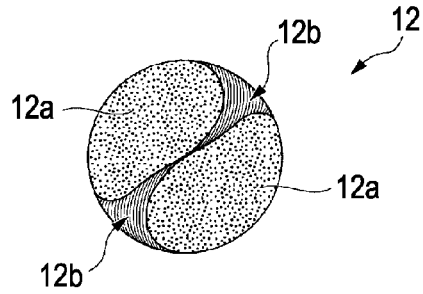
FIGS. 6A and 6B are enlarged views schematically illustrating an absorption member.
Figure 6B:
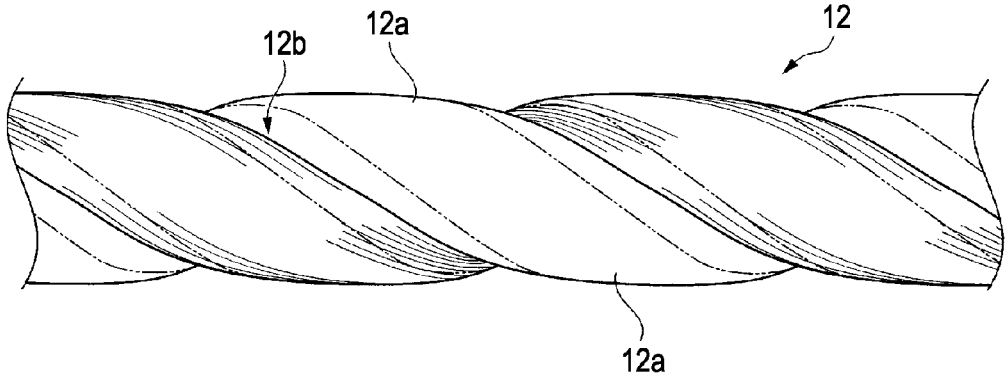

FIGS. 6A and 6B are perspective views illustrating one example of the absorption member 12, FIG. 6A is cross sectional view, and FIG. 6B is planar view. As illustrated in the drawings, the absorption member 12 is formed, for example, by twisting two fiber bundles 12*a* formed from the fiber.

Further, as the other example, the following are suitably used as the absorption member 12: a linear member consisting of a plurality of twisted fiber bundles formed from SUS304; a linear member consisting of a plurality of twisted fiber bundles formed from nylon; a linear member consisting of a plurality of twisted fiber bundles formed from the hydrophilic coated nylon; a linear member consisting of a plurality of twisted fiber bundles formed from aramid; a linear member consisting of a plurality of twisted fiber bundles formed from silk; a linear member consisting of a plurality of twisted fiber bundles formed from cotton; a linear member that bundles a fiber bundle formed from BERIMA (trade name); a linear member that bundles a fiber bundle formed from SOARION (trade name); a linear member consisting of bundled fiber bundles formed from HAMIRON 03T (trade name); a linear member consisting of bundled fiber bundles formed from DYNEEMAHAMIRON DB-8 (trade name); a linear member consisting of bundled fiber bundles formed from VECTRANHAMIRON VB-30 (trade name); a linear member consisting of bundled fiber bundles formed from HAMIRON S-5 COREKEVLASLEEVEPOLYESTER (trade name); a linear member consisting of bundled fiber bundles formed from HAMIRON S-212 COREKEBRASLEEVEPOLYESTER (trade name); a linear member consisting of bundled fiber bundles formed from HAMIRON SZ-10 COREXYRONSLEEVEPOLYESTER (trade name); and a linear member consisting of bundled fiber bundles formed from HAMIRON VB-3 VECTRAN (trade name).

Since the absorption member 12 using the nylon fiber is formed from nylon which is used widely as a general purpose hydro-thread, it is inexpensive.

The absorption member 12 using metal fiber of SUS material can absorb various inks due to excellent corrosion resistance, and can be used repeatedly due to high abrasion resistance compared to resin.

The absorption member 12 using the fiber of ultrahigh molecular polyethylene has a high strength and high chemical resistance, and is resistant to organic solvents, acids, or alkalis. Therefore, due to the fact that the absorption member 12 using the fiber of ultrahigh molecular polyethylene has a high strength, it is possible to pull the absorption member under strong tension and to suppress bending of the absorption member. Therefore, for example, the diameter of the absorption member 12 may be large and the absorptive capacity thereof may be increased, or, in a case that the diameter of the absorption member 12 is not large, the printing precision may be improved due to the fact that the distance from the heads 21A to 21E to the transport area of the recording paper is shorten. Further, the absorption member 12 using the fibers of XYRON or aramid also can obtain the same effect as that of the absorption member 12 using the fiber of ultrahigh molecular polyethylene.

The absorption member 12 using cotton fibers is excellent in ink absorption property.

In the absorption member 12, since the dropped ink is held by surface tension in a valley portion 12*b* (refer to FIG. 6) formed between the fibers and between the fiber bundles 12*a*, ink is absorbed and received.

Further, a part of ink dropped in the surface of the absorption member 12 directly penetrates the interior of the absorption member 12, and the remainder of ink goes along the valley portion 12*b* formed between the fiber bundles 12*a*. Further, a part of the ink penetrating inside the absorption member 12 is gradually moved in the extension direction of the absorption member 12 in the interior of the absorption member 12, and is dispersed and held in the extension direction of the absorption member 12. While the ink which goes along the valley portion 12*b* of the absorption member 12 is going along the valley portion 12*b*, a part of ink gradually penetrates the interior of the absorption member 12 and the remainder of ink remains in the valley portion 12*b*. Therefore, ink is dispersed and held in the extension direction of the absorption member 12. As a result, all of ink dropped on the surface of the absorption member 12 does not stay in the long term at the place where ink was dropped, and the ink is dispersed and absorbed into the surroundings of the place where the ink was dropped.

Further, a formation material of the absorption member 12 actually installed in the printer 1 is appropriately selected in consideration of ink absorbability, ink retention, strength, ink resistance, formability (fluff or fray generation), torsibility, cost, and the like.

Moreover, the ink absorption amount of the absorption member 12 is the sum of the ink amount held between the fibers of the absorption member 12 and the ink amount held in the valley portion 12*b*. Therefore, the formation material of the absorption member 12 is selected so that the ink absorption amount is sufficiently larger than the ink amount discharged by flushing considering the replacement frequency of the absorption member 12.

Further, the ink amount that can be held between the fibers of the absorption member 12 and the ink amount that can be held in the valley portion 12*b* can be defined by the contact angle between ink and the fiber, and a capillary force between the fibers dependent on the surface tension of ink. As a result, the gaps between the fibers are larger through formation using a thin fiber, and the total surface area of the fiber increases, therefore, though the cross-sectional area of the absorption member 12 is same, the absorption member 12 absorbs further much ink amount. Thus, microfiber (ultrafine fiber) may be use as the fiber forming the fiber bundle 12*a* so as to increase the intervals between the fibers.

However, the ink holding force of the absorption member 12 decreases due to the fact that the gaps between fibers increase and the capillary force is lowered. Therefore, it is necessary that the ink holding force of the absorption member 12 is set to such an extent that ink does not drop due to the movement of the absorption member 12 with respect to the gap between fibers.

Moreover, the thickness (diameter) of the absorption member 12 is, for example, 5-75 times to the diameter of the nozzle 24 (nozzle diameter). In the general printer, a gap between the respective nozzle surfaces 23 of the respective recording heads 21A-21E and the recording paper is about 1 MM-2 MM, the diameter of the nozzle is about 0.02 MM. Therefore, if the diameter of the absorption member 12 is equal to or less than 0.5 MM, the absorption member can be disposed between the respective nozzle surfaces 23 and the recording paper without contacting the respective nozzle surfaces or the recording paper. Further, if the diameter of the absorption member is equal to or more than 0.2 MM, the absorption member can catch the discharging ink correctly even in consideration of errors in parts manufacturing. Therefore, the thickness (diameter) of the absorption member 12 may be about 0.2 MM-0.5 MM, that is, it is preferable that the diameter of the absorption member is about 10-25 times the nozzle diameter. Further, it is not necessary that the cross-sectional shape of the absorption member 12 is circular, the cross-sectional shape of the absorption member may be a polygonal shape, or the like. Here, since it is difficult for the absorption member to be fabricated perfectly round, the cross-sectional shape of the absorption member includes a circular shape or an approximately circular shape.

Moreover, in a length of the absorption member 12, it is preferable that the length is sufficiently long relative to the effective print width of the head unit 2. In the print 1 of the embodiment, as described hereinafter, the use completion (ink suction completion) area of the absorption member 12 is consequently wound up, the entirety of the absorption member 12 is replaced when almost the total area of the absorption member 12 has absorbed ink. Therefore, in order to make the replacement duration of the absorption member 12 to practically sustainable lengths of time, it is preferable that the length of the absorption member 12 is a few hundred times the effective print width of the head unit 2.

The absorption member 12 as constructed above is held by a supporting mechanism 9, as illustrated in FIG. 5.

The supporting mechanism 9 includes a traveling mechanism 13 and a moving mechanism 14. In the embodiment, the supporting mechanism 9 is installed at both sides of the head unit 2, that is, at the one side and the other side in the arrangement direction of the recording head 21. Further, in FIG. 5, a part of the head unit 2 is omitted, and only two of the recording heads 21 are shown. Also, in the recording head 21 constituting the head unit 2, it is illustrated that the nozzle row L is formed with a total eight by two rows for each color of (Y), (M), (C) and (BK).

The traveling mechanism 13 is installed with a pair of supporting substrates 15A and 15B disposed at the both sides of the head unit 2, and causes the absorption member 12 to travel from the one side of the recording head 21 toward the other direction side thereof along to the nozzle rows L of the recording head 21. In the embodiment, since the absorption member 12 is installed with two as described above, the traveling mechanisms 13 area also installed with two according with respect to absorption members 12. Further, the number of the absorption members 12 is not limited to two, for example, may be installed as the number of nozzle rows L of the recording head 21. In that case, the number of the traveling mechanisms 13 also may be installed as the number of the absorption members 12.

The traveling mechanism 13 includes a delivering reel 16 (a delivery rotating body) and a delivering motor 16A (a delivery driving portion) driving the delivering reel in the one side-supporting substrate 15A, and includes a winding-reel 17 (a winding-rotating body) and a winding-motor 17A (a winding-driving portion) driving the winding-reel in the other side-supporting substrate 15B. The delivering reel 16 preliminarily winds up the absorption member 12 at predetermined length, and from that state, the absorption member 12 is unwound to head unit 2 side by driving out the absorption member 12. The winding-reel 17 winds up the absorption member 12 which is driven out from the delivering reel 16.

Figure 7:
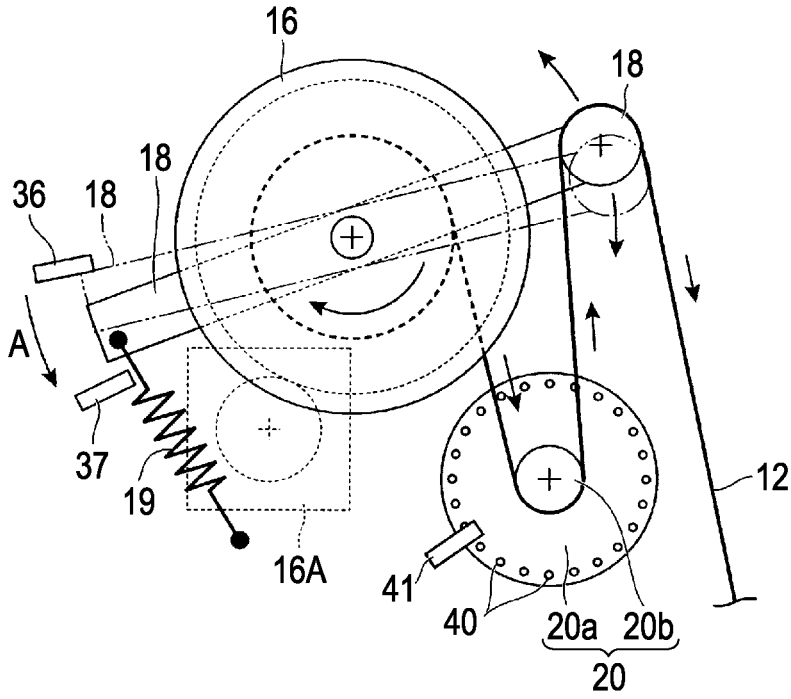
FIG. 7 is an enlarged view of a main part of FIG. 5.

Moreover, as shown in FIG. 7 illustrating the enlarged main part, the supporting substrate 15A includes a regulating lever (a tension regulating member) 18 so as to apply a predetermined tension to the absorption member 12. The regulating lever 18 is formed as a thin and elongated plate like, and is rotatable in the back and forth direction about a rotation shaft, which is the center portion of the regulating lever. Further, the regulating lever 18 is disposed at the downward of the delivery reel 16 (the supporting substrate 15A side), the rotation shaft of the lever is disposed so as to coincide with the rotation shaft of the delivery reel 16.

A pull-up spring 19 (a tension spring) constructed as coil spring is connected to one side of the regulating lever 18, a roller 18*a* is installed so as to be rotatable on the other side of the regulating lever. One side of the tension spring 19 is connected to the regulating lever 18, the other side of the tension spring is fixed to the supporting substrate 15A, and the one side of the regulating lever 18 is biased in the arrow A direction shown in FIG. 7. Through the above construction, the regulating lever 18 is biased to rotate in the arrow direction A by the tension spring 19.

A first sensor 36 and a second sensor 37 are installed at positions which are contactable to one end of the regulating lever 18 at both sides of the one end of the regulating lever 18, that is, both sides of the rotation direction of the lever. The first sensor 36 is disposed at side opposite to the arrow A direction in the one end of the regulating lever 18, and the second sensor 37 is disposed at the arrow A direction side in the one end of the regulating lever 18. The first sensor 36 and the second sensor 37 become ON if they are pressed by the one end of the regulating member 18 and become OFF if the press is released; thus the first sensor 36 and second sensor 37 may be a limit switch. Meanwhile, the resistances of the first sensor 36 and the second sensor 36 to the pressing are sufficiently small, therefore, when the first sensor 36 and the second sensor 37 are pressed to the one end of the regulating lever 18, the first sensor and the second sensor nearly do not resist the pressing force and retreats, and smoothly return to their initial positions through the release of the pressing force. Further, in the embodiment, a sensor portion is formed from the first sensor 36 and the second sensor 37.

Moreover, since the first sensor 36 and the second sensor 37 are installed to sustain the tension of the absorption member 12 within a predetermined range as described hereinafter, the driving of the winding-motor 17A is stopped if the first sensor 36 becomes ON, and the driving of the winding-motor 17A is performed if the first sensor becomes OFF. Further, the driving of the winding-motor 17A is performed along with the driving of the delivery motor 16A is stopped if the second sensor 37 becomes ON.

Moreover, in the embodiment, a position in which the first sensor 36 becomes ON, that is, a position in which the one end of the regulating lever 18 abuts the first sensor 36 and this reaches the predetermined press amount, reaches a first position in the range within which the regulating lever 18 is displaced (rotated). Also, a position in which the second sensor 37 becomes ON, that is, a position at which the one end of the regulating lever 18 abuts the second sensor 37 and this reaches the predetermined press amount, reaches a second position in the range within which the regulating lever 18 is displaced (rotated). The first position and the second position are respectively determined corresponding to the range of the presetting tension of the absorption member 12 as described hereinafter.

The absorption member 12 is rotated around a rotating body 20 for inspection before the absorption 12 unwound (driven out) from the delivery reel 16 is rotated around a roller 18*a* of the other end side of the regulating lever 18. In the rotating body 20 for inspection, a rotating plate 20*a* and a roller 20*b* have a same rotating shaft and are integrally formed, thus, the absorption member 12 unwound from the delivery reel 16 is rotated around the roller 20*b*. That is, the absorption member 12 unwound from the delivery reel 16 is rotated around the roller 18*a* of the regulating lever 18 after rotating around the roller 20*b*.

Here, the roller 20*b* of the rotating body 20 for inspection is turned accompanied by traveling when the absorption member 12 is traveling. Therefore, the rotating plate 20*a* integrally formed with the roller 20*b* is rotated at the same velocity (rotation velocity) to that of the roller 20*b*. A plurality of pulse generating holes (an identification body) 40 is installed at regular intervals along the circumferential direction on an outer periphery of the rotating plate 20*a*. Further, a detection portion 41 for detecting the holes 40 is disposed at a position which is opposite a part of the outer periphery of the rotating plate 20*a*. In the detection portion 41, for example, a light-emitting portion is disposed at one side of the rotating plate 20*a*, and a light-receiving portion is disposed at the other side thereof. Therefore, when light emitted from the light-emitting portion passes through the holes of the rotating plate 20*a*, the light-receiving portion receives light passing through the holes.

The constructed detection portion 41 can detect the number of rotations of the rotating plate 20*a* based on the number of holes detected. Further, due to the fact that the roller 20*b* is turned accompanied with the absorption member 12, the traveling length (traveling distance) of the absorption member 12 is directly proportional to the number of rotations of the rotating plate 20*a*. Therefore, since the rotation of the rotating plate 20*a* can be detected as described above, the traveling length of the absorption member 12 can be correctly detected. Further, in the embodiment, a detection mechanism of the invention is formed from the detection portion 41 and the holes 40 (identification body) of the rotating plate 20*a*.

The absorption member 12 which is rotated around the roller 20*b* is transferred to the roller 18*a* of the other end side of the regulating lever 18 and is rotated around the roller 18*a*. Further, as shown in FIG. 5, the absorption member 12 is rotated around a roller 42 which is installed at the head unit 2 side of the supporting substrate 15A, is passed to the side which is opposite to the nozzle surfaces 23 of the respective recording head 21 of the head unit 2, and is directed toward the supporting substrate 15B. Here, as above described, the absorption member 12 is disposed in a state where the absorption member is extended along corresponding nozzle row L.

In the supporting substrate 15B, a roller 43 is installed at the head unit 2 side, the absorption member 12 which is passed through the head unit 2 is rotated around the roller 43 and is wound up to the winding-reel 17. In this regard, in the embodiment, the absorption member 12 which is rotated around the roller 43 is wound up to the winding-reel 17 via a safety lever 44 which is disposed between the roller 43 and the winding-reel 17.

Figure 8:
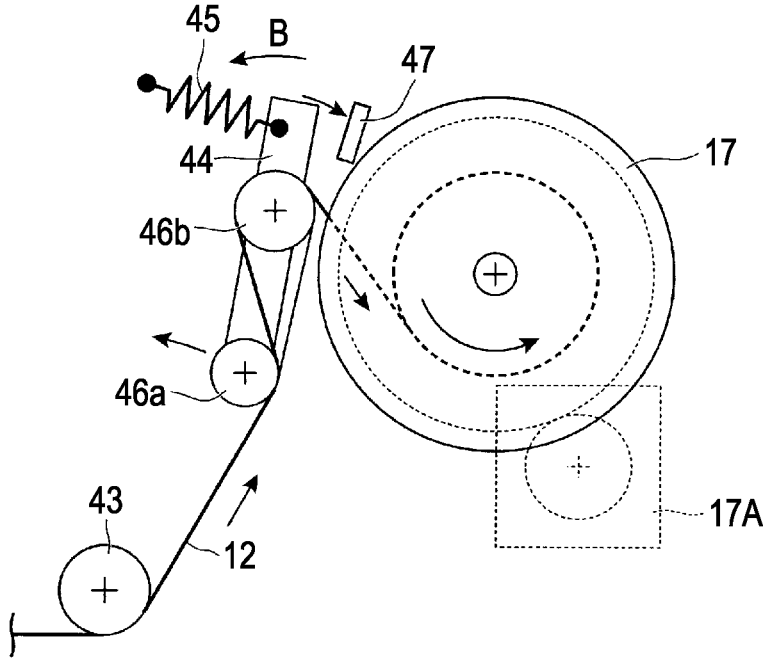
FIG. 8 is an enlarged view of a main part of FIG. 5.

As shown FIG. 8 illustrating a main portion enlarged view, the safety lever 44 is formed as in thin and elongated plate shape, and is rotatable in the back and forth direction about a rotation shaft, which is a center portion of the safety lever. A pull-up spring 45 (a tension spring) which is constructed as coil spring is connected to one side of the safety lever 44, a roller 46*a* is installed to be rotatable at the other side of the safety lever. Further, another roller 46*b* is installed to be rotatable at the one end side of the rotating shaft (not shown).

One end side of the tension spring 45 is connected to the safety lever 44, the other end side of the tension spring is fixed to the supporting substrate 15B, and the one end side of the safety lever 44 is biased in the arrow B direction shown in FIG. 8. Through the above construction, the safety lever 44 is biased so as to rotate in the arrow B direction by the tension spring 45.

In a side opposite to the tension spring 45 of the one end of the safety lever 44, a safety sensor portion 47 is installed at a position which is contactable to the one end of the safety lever 44. The safety sensor portion 47 become ON if it is pressed by the one end of the safety lever 44, and the safety sensor portion become OFF if the press is released, thus the safety sensor portion may be a limit switch. Further, a winding-motor 17A is stopped if the safety sensor portion 47 becomes ON. Also, in the embodiment, a safety mechanism consists of the safety lever 44, the tension spring 45, the rollers 46*a* and 46*b*, and the safety sensor portion 47.

Through the safety mechanism, if the tension of the absorption member 12 which is rotated around the roller 46*a* and 46*b* becomes equal to or more than a predetermined amount, the one end of the safety lever 44 is rotated to the direction opposite to the arrow B against the biasing force of the tension spring 45. Accordingly, the safety sensor portion 47 is pressed and becomes ON, the driving of the winding-motor 17A is stopped, and the rotation of the winding-reel 17 is stopped. Therefore, as described hereinafter, cutting of the absorption member 12 by forcefully tensioning the absorption member is avoided.

Moreover, as shown in FIG. 5, a position of the absorption member 12 which is opposite to the head unit 12 is determined through the roller 42 of the supporting substrate 15A and the roller 43 of the supporting substrate 15B. Therefore, the rollers 42 and 43 are positioned and disposed so that the absorption member 12 which is rotated around and traveled to the rollers can be opposite to the nozzle row L corresponding to the recording head 21.

A moving mechanism 14 causes the absorption member 12 to move to a direction R which intersects (in the embodiment, is perpendicular to) the extension direction P of the nozzle rows L. That is, the moving mechanism 14 causes the absorption member 12 to move to between a flushing position in which the absorption member is opposite to the nozzles 24 and absorbs ink droplets (fluid) ejected from the nozzles 24 and a retreating position in which the absorption member 12 retreats from the flight path of ink droplet (fluid) ejected from the nozzles 24. Further, the moving mechanism 14 of the embodiment can move the respective absorption member 12 from a position which is opposite a certain nozzle row to a position which is opposite to a different nozzle row.

That is, the moving mechanism 14 includes a pair of moving mechanism portions 14A and 14B installed in the supporting substrates 15A and 15B. Since the moving mechanism portions 15A and 15B are operated in synchronization, the supporting substrates 14A and 14B are moved to same direction as the direction R and simultaneously as same length.

The moving mechanism portions 14A and 14B include a ball screw stage 53 that is installed in the upper surface side of the respective supporting substrates 15A and 15B (the surface side opposite to the surface side at which the delivery reel 16 or the winding-reel 17 is installed); a motor 55 that rotates a male ball screw 54 and consists of a stepping motor, and the like; and a fixing block 56 that is fixed to each of the supporting substrates 15A and 15B and has a female screw portion (not shown) is moveably threadably mounted to the ball screw 54. Further, the motor 55 and the ball screw stage 53 are fixed to the printer 1 by a fixing member (not shown).

In the above constructed moving mechanism portions 14A, 14B, the ball screw 54 is rotated by rotating the motor 55, and the fixing block 56 threadably mounted to the ball screw 54 is moved to a longitudinal direction of the ball screw 54, that is, R direction of FIG. 5. Therefore, the supporting substrate 15A and 15B fixed to the moving mechanism portion 14A and 14B is moved in the same direction as the direction R and simultaneously by the length. Further, according to the movement of the supporting substrate 15A and 15B, the absorption member 12 also is similarly moved. Also, the motor 55 may be rotated to forward and backward directions, therefore, the fixing block 56, the supporting substrate 14A, 14B, or the absorption member 12 also may be moved in both directions in both directions in the R direction.

Further, the motor 55 is controlled by a control portion (not shown), therefore, the moving mechanism portion 14 is moved so that the position of the respective absorption members 12 about the head unit 2 (the nozzle rows L) varies as preset. Specifically, in shown in FIGS. 9A and 9B, the moving mechanism portion causes the absorption member 12 to move with a preset moving distance along the direction R perpendicular to the extension direction P of the nozzle rows L corresponding to the head unit 2, that is, along the transporting direction of the recording paper. Further, the moving mechanism of the invention is not limited to the construction including the ball screw 54, for example, may include a construction which uses a rack and pinion or the like.

The moving mechanism 14 of the invention causes the absorption member 12 to move between the flushing position and the evacuating position.

Figure 9A:
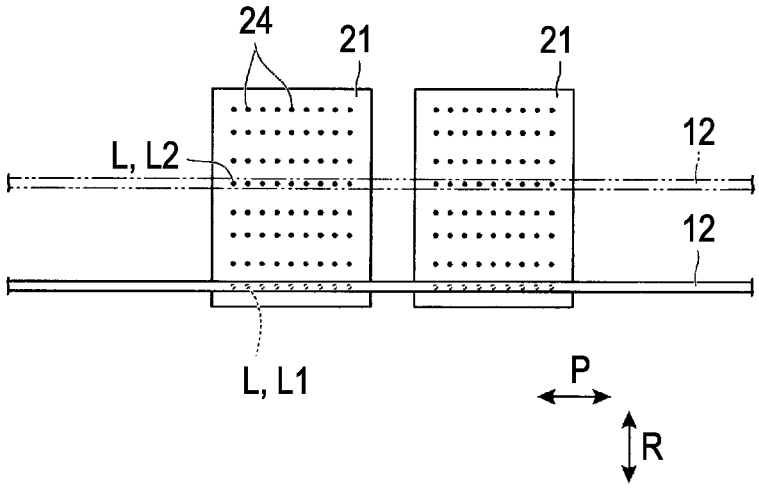
FIG. 9 is a bottom view of movement positions of the absorption member.

Here, as shown in FIG. 9A, the flushing position is the position in which the absorption member 12 can receive and absorb ink droplets discharged from the nozzle rows L during the flushing operation in a state where the absorption member 12 is opposite to the corresponding nozzle rows L (a plurality of nozzles 24 constituting the nozzle rows L), that is, the flushing position is in the position in which the absorption member 12 is disposed on ink flight path.

Figure 9B:
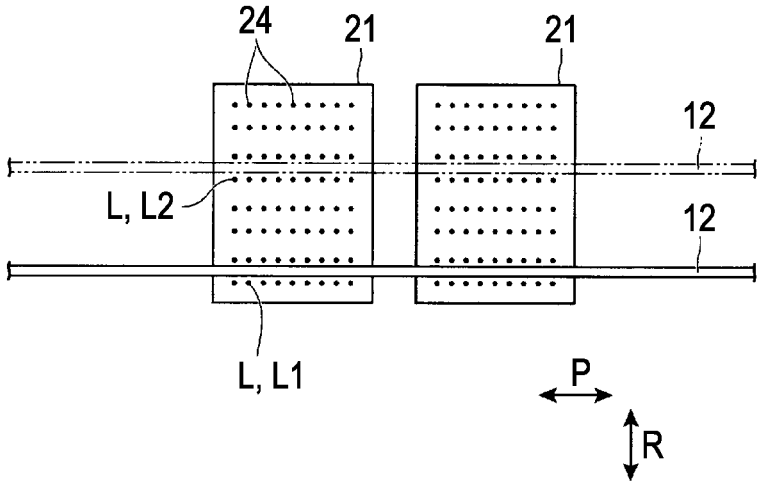

Meanwhile, as shown in FIG. 9B, the evacuating position of the absorption member 12 is the position in which the absorption member 12 does not absorb ink droplets for recording discharged from the respective nozzles 24 during the recording operation in a state where the absorption member 12 is not opposite to (not overlapped as planar view) the nozzle rows L (a plurality of nozzles 24 constituting the nozzle rows L). Further, here, the condition in which the nozzle rows L are opposite the absorption member 12 not only means the condition in which the centers of the nozzles 24 are overlapped with the center of the absorption member 12 in planar view, but means that the nozzles 24 are disposed within the center of the width of the absorption member 12 in planar view. If the absorption member 12 is disposed to the condition, the absorption member 12 can absorb ink discharged from the nozzles 24.

Further, in the moving mechanism 14 of the embodiment, the absorption member 12 is not moved only to between the flushing position and the evacuating position. That is, the absorption member may be moved from a position corresponding to the nozzle row L1 as shown with a solid line respectively in FIGS. 9A and 9B to a position corresponding to a different nozzle row L2 as shown with two-dot chain line. Of course, the possible corresponding nozzle rows L are not limited to two rows, may be equal to three or more rows.

Further, in the embodiment, as shown in FIG. 5, the absorption member 12 is installed by two, thus, the moving mechanism 13 also is installed by twos in corresponding to the two absorption member 12. The two moving mechanisms 13 include substantially same structures, and represent same effects. Therefore, only one moving mechanism 13 is explained in the description, and the explanation of other moving mechanism 13 is omitted.

Moreover, in FIG. 1, only one set of the head module 2, the maintenance unit 10, and the flushing unit 11 is illustrated. However, in practice, one set of the head module 2, the maintenance unit 10 and the flushing unit 11 is further installed in the transporting direction of the recording paper. These two sets have same structure mechanically, and are disposed offset in the horizontal direction (arrangement of the heads 21A to 21E) perpendicular to the transporting direction of the recording paper. More specifically, as view in the transporting direction of the recording paper, the heads 21A to 21E of the second set of the head module 2 are disposed between the heads 21A to 21E of the first set of the head module 2.

Therefore, the two sets of the head module 2, the maintenance unit 10 and the flushing unit 11 are offset disposed in the horizontal direction perpendicular to the transporting direction of the recording paper, and totally the heads 21A to 21E are disposed in a zigzag pattern, and can discharge ink to total area of the effective print width.

Here, in the two sets of heads 21A to 21E which are disposed in a zigzag pattern by the two sets of head modules 2, a pitch of the respective nozzles 24 constituting the respective nozzle rows L is regularly formed at between the heads which is offset and adjacent in the horizontal direction perpendicular to the transporting direction of the recording paper. That is, the offset and adjacent heads may be disposed so that the pitch between nozzles 24 and 24 which are disposed at the end of inner side to each other between the heads is same as the pitch between the adjacent nozzles 24 and 24 within the same head. However, the offset and adjacent head may be disposed so that one or a plurality of nozzles 24 which are disposed the end side of the inner side to each other between the heads line up by one row or plural rows along the transporting direction of the recording paper between the heads. In a case that is disposed as above described, it is preferable that fluid does not be ejected from the nozzle 24 of the one side head in the nozzles 24 and 24 which is lined up by one row or plural rows between the heads. According to the above construction, the pitch between the respective nozzles 24 used is constant.

Moreover, when the heads 21A to 21E is conjunctionally arranged in the direction perpendicular to the transporting direction of the recording paper, the head module 2, the maintenance unit 10 and the flushing unit 11 may be only one set. In the case, since the sufficient intervals between the heads 21A to 21E are not formed, it is difficult for the cap portions 61A to 61E included in the maintenance unit 10 to be installed to respective heads 21A to 21E. Therefore, it is preferable that a single cap portion totally surrounding the nozzles 24 of the heads 21A to 21E is used.

Next, an operation of the printer 1 of the embodiment is explained related to the holding of the absorption member 12 and the traveling thereof by the moving mechanism 13. Further, the operation of the printer 1 of the embodiment is integrally controlled by a control portion (control device) (not shown).

First, after the flushing is ended at a state of FIG. 9A, for preparation of the ink ejecting to the recording paper through recording head 21, the absorption member 12 is moved from the flushing position to the evacuating position by the moving mechanism 14 as shown in FIG. 9B. In this time, both of the driving of the delivery motor 16A and the winding-motor 17A which are shown in FIG. 5 are stopped, therefore, the absorption member 12 held between the delivery reel 16 and the winding-reel 17 is held with a preset and predetermined tension.

Moreover, in this time, as shown in two-dot chain line of FIG. 7, the regulating lever 18 cause the first sensor 36 become ON, that is, the regulating lever 18 reaches a first position within the ranges in which the regulating lever 18 is displaced. Therefore, the absorption member 12 displaces the regulating lever 18 to the side opposite to the arrow A direction with a force which is over the biasing force of the tension spring 19, and the tension becomes equal to or more than a first tension corresponding to the biasing force of the tension spring 19.

In the state, for example, in order to wind an area in where ink has already been absorbed/received by the flushing operation to winding-reel 17 side and opposing a new area in where ink has not been absorbed/received to the head unit 2, the delivery motor 16A is driven and the delivery reel 16 is rotated. Accordingly, since the winding-reel 17 is stopped, the unwinding-amount (the driving out-amount) of the absorption member 12 which is unwound between the delivery reel 16 and the winding-reel 17 increases (becomes long), therefore, the tension of the absorption member 12 weakens.

As a result, since the tension becomes less than the first tension, as shown in the solid line of FIG. 7, the regulating lever 18 is separated from the first position, and reaches between the first position and the second position (the position in where the second sensor 37 becomes ON). Therefore, when the regulating lever 18 is separated from the first position, the first sensor 36 detects this and drives the winding-motor 17A, and rotates the winding-reel 17. Thus, due to the fact that the delivery reel 16 and the winding-reel 17 are rotated together, the tension of the absorption member 12 is stabilized, the displacement of the regulating lever 18 also is sustained within a predetermined range, and the absorption member 12 is held between the first position and the second position as shown in the solid line of FIG. 7.

Here, the respective velocities of the delivery motor 16A and the winding-motor 17A are preset to nearly identical, therefore, the respective velocities of the delivery reel 16 and the winding-reel 17 become nearly identical. Then, in the winding-amount of the absorption member 12 which is wound up in the delivery reel 16 and winding-reel 17, initially, the winding-up amount of the delivery reel 16 side is much than the winding-reel 17 side, and, according to the thereafter repeated use, the winding-amount of the winding-reel 17 side increases. Therefore, since differences in the winding-amounts between the delivery reel 16 and the winding-reel 17 occur, differences in the winding-diameter of the absorption member 12 occur. Thus, though the delivery reel 16 and the winding-reel 17 are rotated in same velocity, differences between the driving out-length (length to be wound up) and the winding-length per unit time occur by the differences in the winding-diameter. Therefore, only when the velocity of the delivery motor 16A and the velocity of the winding-motor 17A are controlled respectively, it is difficult for the length of absorption member 12 which is held between them to always be constant, practically, the hold length is varied, albeit only slightly and continuously.

Therefore, for example, if the driving out-length is greater than the winding-length, the tension of the absorption member 12 is further weakened, and becomes the second tension which is weaker than the first tension. Here, for example, the first tension is set to upper limit of desired tension ranges of the absorption member 12 which is held between the delivery reel 16 and the winding-reel 17, and the second tension is set to lower limit of the desired tension ranges.

When the tension of the absorption member 12 becomes equal to or less than the second tension, the regulating lever 18 reaches the second position, and the second sensor 37 becomes ON. Since the second sensor 37 becomes ON, the delivery motor 16A is stopped, and driving of the winding-motor 17A is sustained (cause the winding-motor 17A drive). Therefore, the unwinding-length (amount) of the absorption member 12 which is held (is unwound) between the delivery reel 16 and the winding-reel 17 becomes shorter (less), and the tension increases and equal to or more than the second tension.

As a result, the regulating lever 18 is separated from the second position, and again reaches between the first position and the second position. As the described, if the regulating lever 18 is separated from the second position, the second sensor 37 detects this and becomes OFF, the delivery motor 16A is driven, and the delivery reel 16 is rotated. Therefore, the delivery reel 16 and the winding-reel 17 are again rotated together, the tension of the absorption member 12 is stabilized, and the displacement of the regulating lever 18 is held within the predetermined range.

Further, for example, if the driving out-length falls below the winding-length, the tension of the absorption member 12 becomes strong, and again is equal to or more than the first tension. Accordingly, the regulating lever 18 again reaches the first position, and the first sensor 36 becomes ON. Since the first sensor 36 becomes ON, the delivery motor 16A is stopped, and driving of the winding-motor 17A is sustained (cause the winding-motor 17A drive). Therefore, the unwinding-length (amount) of the absorption member 12 which is held (is unwound) between the delivery reel 16 and the winding-reel 17 becomes long (much), and the tension weakens and becomes lower than the first tension.

As a result, the regulating lever 18 is separated from the first position, and again reaches between the first position and the second position. As the described, if the regulating lever 18 is separated from the first position, the first sensor 36 detects this and becomes OFF, the winding-motor 17A is driven, and the winding-reel 17 is rotated. Therefore, the delivery reel 16 and the winding-reel 17 are again rotated together, the tension of the absorption member 12 is stabilized, and the displacement of the regulating lever 18 is held within the predetermined range.

Therefore, if the tension of the absorption member 12 varies over ranges of the preset first tension and second tension, the displacement of the regulating lever 18 also exceeds the predetermined ranges between the first position and the second position, due to the fact that this is detected by the first sensor 36 or the second sensor 37, the driving and stopping of the delivery reel 16 (the delivery motor 16A) and/or the winding-reel 17 (the winding-motor 17A) are automatically controlled. Herewith, since the displacement of the regulating lever 18 is regulated so as to return to within the predetermined range, the tension of the absorption member 12 is stabilized within the predetermined range.

Further, when the traveling of the absorption member 12 is stopped by the traveling mechanism 13, as a completion operation, a control (command) which causes the delivery motor 16A stop has been to the control device. Accordingly, since only the winding-motor 17A is driven and only the winding-reel 17 is rotated, the unwinding-length (amount) of the absorption member 12 which is held (is unwound) between the delivery reel 16 and the winding-reel 17 becomes shorter (less), the tension becomes strong and equal to or more than the first tension. Accordingly, the regulating lever 18 again reaches the first position, and the first sensor 36 becomes ON. Since the first sensor 36 becomes ON, the delivery motor 16A is stopped.

Further, in normal time, due to the fact the first sensor 36 becomes ON, the winding-motor 17A is driven, here, it is completion time, since command for the completion operation has been applied to the control device, the winding-motor 17A is stopped without driving the winding-motor 17A. Therefore, the regulating lever 18 becomes a state where the regulating lever 18 cause the first sensor is ON as shown in two-dot chain line of FIG. 7, that is, becomes a state where the regulating lever 18 reaches the first position within ranges in which the regulating lever 18 is displaced.

Herewith, in the completion time, due to the fact that the absorption member 12 is consistently sustained with a definite tension, the behavior variation of the absorption member 12 by the tension variation is not occurred, and a vibration, and the like, are not occurred.

Further, in the completion time, that is, the absorption member 12 becomes equal to or more than the first tension and the regulating lever 18 is the first position, since the traveling of the absorption member 12 is stopped, the absorption member 12 is plastically deformed and extended, and the tension of the absorption member 12 weakens and becomes lower than the first tension. Accordingly, since the regulating lever 18 is separated from the first position, the winding-motor 17A is driven and the winding-reel 17 is rotated. Moreover, the absorption member 12 is wound up to the winding-reel 17 with an extent corresponding to the extended amount, therefore, the tension of the absorption member 12 again becomes equal to or more than the first tension. Herewith, the regulating lever 18 again reaches the first position, and the winding-motor 17A is again stopped. Therefore, for example, though the absorption member 12 is stopped for an extended period, the tension is sustained to a stabilized state.

Moreover, the absorption member 12 is unwound from the delivery reel 16, and when the absorption member 12 is moved by winding to the winding-reel 17, in the mid-course where the absorption member 12 reaches the roller 18*a* of the regulating lever 18 from the delivery reel 16, the absorption member is rotated around the roller 20*b* of the rotating body 20 for inspection as described above.

At the time, due to the fact that the roller 20*b* is turned accompanied by the traveling of the absorption member 12, the rotating body 20 for inspection is rotated according to the traveling length (traveling distance) of the absorption member 12. Since the number of rotations of the rotating body 20 for inspection is directly proportional to the traveling length (traveling distance) of the absorption member 12, the traveling length of the absorption member 12 can be correctly detected by detecting the holes 40 of the rotating plate 20*a* through the detection portion 41.

Therefore, as described above, in order to wind an area in where ink has already been absorbed/received by the flushing operation to winding-reel 17 side and opposing a new area in where ink is not absorbed/received to the head unit 2, when the delivery motor 16A is driven and the delivery reel 16 is rotated, for example, the length of the area in where the ink is absorbed/received is set as the driving out-amount of the absorption member 12. Further, by an inspection mechanism consisting of the rotating body 20 for inspection, the inspection portion 41, and the holes 40 of the rotating plate 20*a*, the traveling length of the absorption member 12 which is actually traveled is detected. Also, if the detected value is the set driving out-amount, the completion operation of the control device is performed as described above.

According to the described construction, the absorption 12 more than necessary does not be driven out (is traveled) and not be transferred to winding-reel 17, the area, in where the absorption member 12 is wound up to the winding-reel 17 in a state where ink is not absorbed, does not increase, therefore, it is prevented that the use efficiency of the absorption member 12 is lowered.

Further, even though it is considered that the length of the traveling absorption member 12 is detected by only detecting the number of rotations of the delivery reel 16 or the winding-reel 17, as described above, the winding-amount of the absorption member 12 which is wound up to the delivery reel 16 or the winding-reel 17 is varied according to the repeated use. Therefore, since the respective winding-diameter also is varied, the number of rotations of the delivery reel 16 or the winding-reel 17 does not correctly correspond to the length of the traveling absorption member 12. Thus, in compassing the length of the absorption member 12 with more precision and preventing the lowering of use efficiency of the absorption member 12, the inspection mechanism, which consists of the rotating body 20 for inspection, the inspection portion 41, and the holes 40 of the rotating plate 20*a*, is effective.

Moreover, after the absorption member 12, which is passed through the side opposite to the head unit 2 and is moved (travels) to the supporting substrate 15B side, is rotated around the roller 43, the absorption member is rotated around the roller 46*a* and the roller 46*b* of the safety lever 44 in the order before being wound up to the winding-reel 17. Therefore, if the tension of the absorption member 12 is equal to or more than the predetermined value, the driving of the winding-motor 17A is stopped by the safety mechanism including the above described safety lever 44.

That is, for example, if the remainder of the absorption member 12 wound to the delivery reel 16 becomes loss, or if the absorption member 12 is unexpectedly caught up and the tension of the absorption member 12 become equal to or more than a predetermined tension, the one end side of the safety lever 44 is rotated to the direction opposite to the arrow B against the biasing force of the tension spring 45, the safety sensor portion 47 is pressed and becomes ON, and the driving of winding-motor 17A is stopped and the rotation of the winding-reel 17 is stopped.

Therefore, problems such as the cutting of the absorption member 12 by forcibly tensioning the absorption member 12 can be avoided.

Herewith, the absorption member 12 is made to travel, after the new area in where ink is not absorbed/received is opposite to the head unit 2, when the flushing is performed again, the moving mechanism 14 is operated. Thus, the absorption member 12 is moved from the retreating position shown in FIG. 9B to the flushing position shown in FIG. 9A, and, thereafter, the predetermined flushing operation is performed.

Further, after the flushing operation is performed with plural times, the absorption member 12 is wound up to the winding-reel 17 with the same extent as wound up to the delivery reel 16, if the winding of the absorption member 12 through the winding-reel 17 is ended, the new is exchanged.

According the printer 1 as constructed above, due to the fact that the absorption member 12 has a predetermined tension applied by the regulating lever 18, the absorption member 12 which is stopped between the delivery reel 16 and the winding-reel 17 can be held to a stabilized condition through the predetermined tension. Further, even when the absorption member 12 is made to travel by the moving mechanism 13, the displacement of the regulating lever 18 is detected by the first sensor 36 and the second sensor 37, due to the fact that the delivery motor 16A and/or the winding-motor 17A is controlled so that the displacement of the regulating lever 18 is within a predetermined range, the displacement of the regulating lever 18 is within the predetermined range by controlling the delivery motor 16A or the winding-motor 17A, and the tension of the traveling absorption member 12 also can be stabilized.

Therefore, for example, even though the loose of the absorption member 12 is occurred and the vibration is caused, problems, which are that the area receiving ink is contact with the recording head 21 or the recording paper and the recording head 21 or the recording paper is contaminated, can be prevented.

Moreover, due to the fact that the traveling length of the absorption member 12 is correctly detected by the rotating body 20 for inspection and the inspection mechanism, the absorption 12 more than necessary does not be driven out (is made to travel) and not be transferred to winding-reel 17, the area, in where the absorption member 12 is wound up to the winding-reel 17 in a state where ink is not absorbed, does increase, therefore, it is prevented that the use efficiency of the absorption member 12 is lowered.

Moreover, the linear absorption member 12 is disposed between the recording head 21 and the recording paper, furthermore, due to the fact that ink droplet is received and absorbed during the flushing by moving the absorption member 12 and depositing the absorption member opposite to the nozzles of the recording head 21, the flushing operation can be performed without moving the head unit 2. Therefore, the flushing operation can be realized in a short time at an appropriate time.

Next, a second embodiment of a printer as the fluid ejecting apparatus of the invention will be explained.

Figure 10:
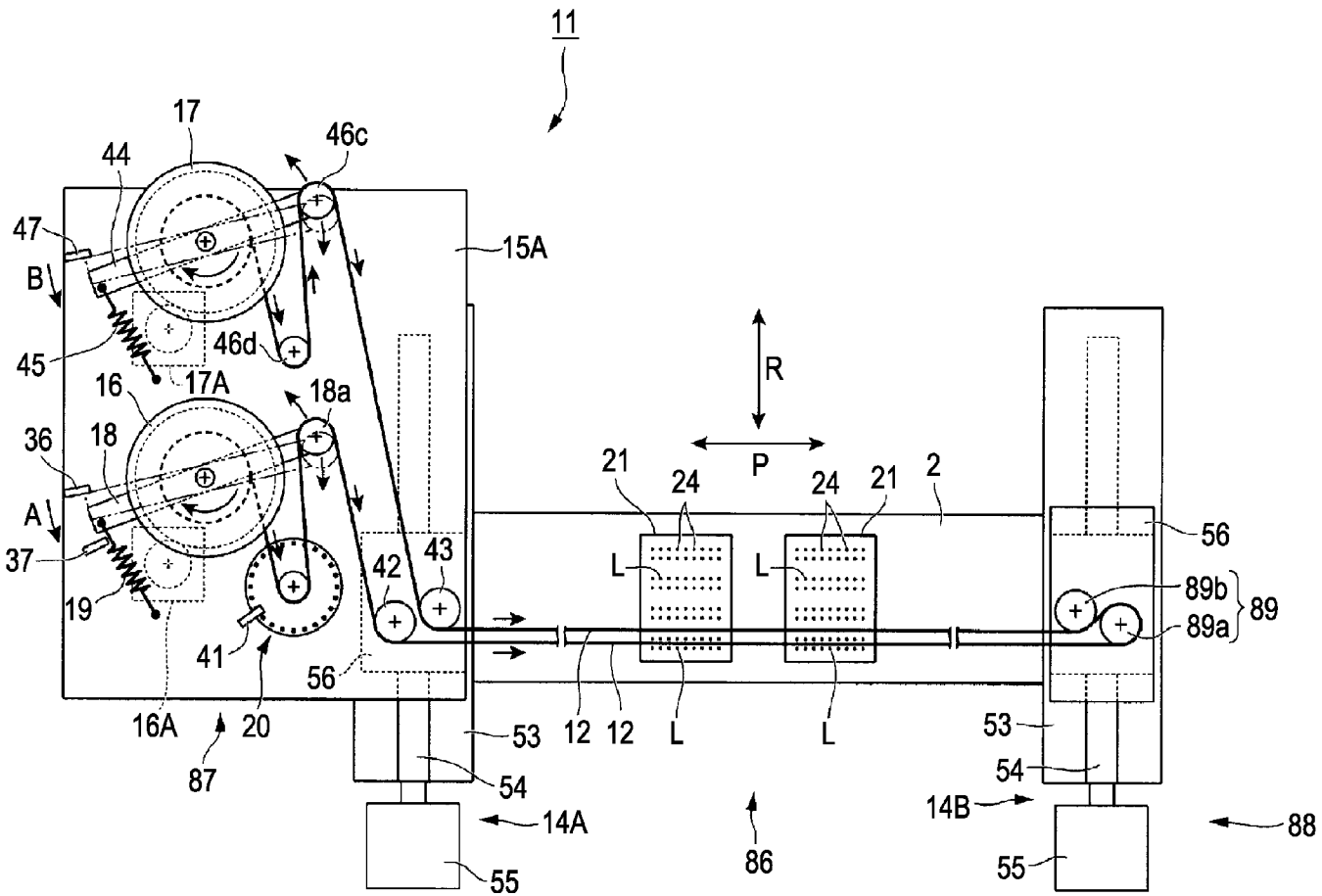
FIG. 10 is a bottom view illustrating a schematic structure of a flushing unit of a second embodiment.

FIG. 10 is bottom view illustrating a head unit 2 in a flushing unit 11 of a printer of the second embodiment.

The main differences between the second embodiment shown in FIG. 10 and the first embodiment shown in FIG. 5 are as follows: in the first embodiment, the delivering reel 16 is disposed in the one side supporting substrate 15A, the winding-reel 17 is disposed in the other side supporting substrate 15B, the absorption member 12 is made to travel from the delivery reel 16 toward the winding-reel 17, therefore, the absorption member is made to travel (is moved) from the one side of the nozzle rows L of the recording head 2 to the other side thereof in the head unit 21, on the other hand, in the second embodiment, after the absorption member 12 is made to travel (is moved) from the one side of the nozzle rows L toward the other side thereof, the absorption member 12 is rotated around a reversal roller and again is directed to the one side.

That is, a supporting mechanism 86 of the printer shown in FIG. 10 includes a traveling mechanism 87 and a moving mechanism 88, the traveling mechanism 87 includes an one side supporting substrate 15A and the reversal roller 89 that is disposed on a fixing block 56 constituting the other side-moving mechanism portion 14B.

The supporting substrate 15A includes: the delivery reel 16, the delivery motor 16A, the regulating lever 18, the pull-up spring (the tension spring) 19, the first sensor 36, the second sensor 37, the rotating body 20 for inspection, the detection portion 41, and the roller 42, which are shown in FIGS. 5 and 7.

Moreover, the winding-reel 17, the winding-motor 17A, the safety lever 44, the tension spring 45, the safety sensor portion 47, and the roller 43, which are installed in the supporting substrate 15B of the first embodiment, also are installed in the supporting substrate 15A of the second embodiment. However, in the embodiment, the safety lever 44 is disposed on the downside of the winding-reel 17 (that is, the supporting substrate 15A side), and is disposed so that the rotating shaft of the safety lever 44 is coincided with the rotating shaft of the winding-reel 17.

Moreover, only the roller 46C is installed to be rotatable in the other side of the safety lever 44. Also, it is same as the first embodiment that the tension spring 45 is connected to the one side of the safety lever.

Further, the roller 46D is installed in the neighborhood of the winding-reel 17, the absorption member 12 rotated around the roller 46C is wound up to the winding-reel 17 via the roller 46D.

Meanwhile, the reversal roller 89 is installed on the fixing block 56 constituting the other side-moving mechanism portion 14B. The reversal roller 89 consists of a pair (a plurality) of roller 89*a*, 89*b*, and the interval between the rollers is adjustable. In the rollers 89*a* and 89*b*, the one side-roller 89*a* is disposed corresponding to the roller 42 of the supporting substrate 15A, and the other side-roller 89*b* is disposed corresponding to the roller 43 of the supporting substrate 15A.

That is, the roller 42 and the roller 89*a* are disposed so as to position at one side and other side on a line parallel to the extension direction P of the nozzle rows L, and, in the same manner, the roller 43 and the roller 89*b* also is disposed so as to position at the one side and the other side. Further, the roller 42 and the roller 43 installed in the supporting substrate 15A is disposed so that the positions of absorption member 12 which is rotated around the rollers, that is, the places of direction R perpendicular to the extension direction P, are same as a pitch between adjacent nozzle rows L and L of a plurality (eight rows in the embodiment) of nozzle rows L formed in the recording head 21.

Therefore, the rollers 89*a* and 89*b* disposed corresponding to the rollers 42 and 43 also is disposed so that the intervals of the places for positioning of the absorption member 12 are same as the pitch between the adjacent nozzle rows L and L. Further, the gaps between the rollers 89*a* and 89*b* or between the rollers 42 and 43 are adjustable respectively by a heretofore known means.

In the traveling mechanism 87 of the embodiment constructed as above, after the absorption member 12 which is unwound (driven out) from the delivery reel 16 is rotated around the roller 42, the absorption member 12 is passed through the side opposite to the head unit 2. Continuously, the absorption member 12 reaches the roller 89*a* in the reversal roller 89, and the absorption member 12 in the outward thereof is extended along the nozzle rows L. Also, after the absorption member is rotated around the roller 89*a*, the absorption member is again passed through the side opposite to the head unit 2 via the roller 89*b* to reach the roller 43, and the absorption member 12 in a homeward thereof also is extended along the nozzle rows L.

Moreover, the absorption member 12 which is rotated around the roller 43 rotates the roller 46C installed at the safety lever 44, and is wound up to the winding-reel 17 via the roller 46D. Therefore, also in the embodiment, for example, if the remainder of the absorption member 12 wound to the delivery reel 16 becomes loss, or if the absorption member 12 is unexpectedly caught up and the tension of the absorption member 12 become equal to or more than predetermined tension, the one end side of the safety lever 44 is rotated to the direction opposite to the bias direction against the biasing force of the tension spring 45, the safety sensor portion 47 is pressed and becomes ON, and the driving of winding-motor 17A is stopped and the rotation of the winding-reel 17 is stopped.

Herewith, inconvenience such as the cutting of the absorption member 12 by tensioning the absorption member 12 forcedly is avoided.

Also, in the printer constructed above, due to the fact that the absorption member 12 has a predetermined tension applied by the regulating lever 18, the absorption member 12 which is stopped between the delivery reel 16 and the winding-reel 17 can be held to a stabilized condition through the predetermined tension. Further, even when the absorption member 12 is made to travel by the moving mechanism 87, the displacement of the regulating lever 18 is detected by the first sensor 36 and the second sensor 37, due to the fact that the delivery motor 16A and/or the winding-motor 17A is controlled so that the displacement of the regulating lever is within a predetermined range, the displacement of the regulating lever 18 is within the predetermined range by controlling the delivery motor 16A or the winding-motor 17A, and the tension of the traveling absorption member 12 also can be stabilized.

Therefore, for example, slackness of the absorption member 12 occurs and vibrations are caused, problems, which are that the area receiving ink is contact with the recording head 21 or the recording paper and the recording head or the recording paper become contaminated, can be prevented.

Moreover, due to the fact that the delivery reel 16 and the winding-reel 17 are intensively arranged in the one side of the nozzle rows L, miniaturization of the printer can be improved. Further, since simultaneous absorption of ink ejected by two different nozzle rows L can be performed by one moving mechanism 87, additionally, miniaturization of the printer can be improved.

Next, a third embodiment of a printer as a fluid ejecting apparatus of the invention will be explained.

Figure 11:
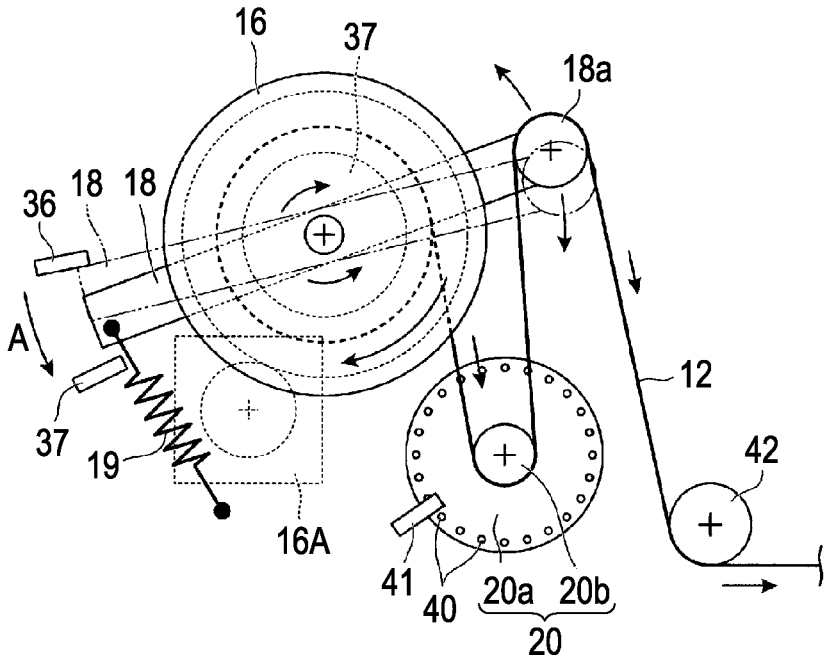
FIG. 11 is a main-part enlarged view to illustrate a third embodiment.

FIG. 11 is an enlarged view of the main parts illustrating the delivery reel 16 and the neighborhood thereof in the printer of the third embodiment.

A main differences between the third embodiment shown in FIG. 11 and the first embodiment shown in FIG. 7 are that, in the third embodiment, as a sensor portion, a third sensor 38 is added to the first sensor 36 and second sensor 37.

That is, in the third embodiment, in a state where the regulating lever 18 is displaced between the first sensor 36 (the first position) and the second sensor 37 (the second position), the third sensor 38 detects a displacement amount from a reference position (for example, the first position or the second position), and controls driving of the delivery motor 16A and the winding-motor 17A. As the third sensor 38, a tension meter is used in the embodiment. The tension meter (the third sensor 38) is directly connected and disposed at the rotating shaft of the regulating lever 18.

Moreover, The tension meter is respectively connected to the delivery motor 16A and the winding-motor 17A, and controls the rotation velocities of the delivery motor and the winding-motor. That is, the tension meter (the third sensor 38) changes the output value according to the displacement amount from the reference position of the regulating lever 18 which is varied according to the tension variation of the absorption member 12, therefore, the rotation velocities of the delivery motor 16A and the winding-motor 17A are respectively changed.

Specifically, if the regulating lever 18 comes close to the first sensor 36 side (the first position side), the rotation velocity of the winding-motor 17A is progressively slower. Therefore, in a case that the rotation velocity of the winding-motor 17A is constant, when the regulating lever 18 causes the first sensor 36 to become ON (when reach the first position), the winding-motor 17A is abruptly stopped, and it can be suppressed that a reaction force thereof is transmitted to the absorption member 12. Further, if the regulating lever 18 comes close to the second sensor 37 side (the second position side), the rotation velocity of the delivery motor 16A is progressively slow. Therefore, in a case that the velocity of the delivery motor 16A is constant, when the regulating lever 18 cause the second sensor 37 become ON (when reach the second position), the delivery motor 16A is abruptly stopped, and it can be suppressed that the reaction force thereof is transmitted to the absorption member 12.

Therefore, according to the printer of the embodiment, not only ON/OFF control by which the delivery motor 16A or the winding-motor 17A is only driven and/or stopped by the first sensor 36 and the second sensor 37, but also the control of the delivery motor 16A (delivery reel 16) or the winding-motor 17A (winding-reel 17) according to the displacement amount of the regulating lever 18 (that is, the tension of the absorption member 12), is performed, thus, the tension of the absorption member 12 can be varied more smoothly. Therefore, it is possible to better prevent the absorption member 12 from generating vibrations.

As above, these preferred embodiments according to the invention are explained with reference to drawings, however, the invention is not limited to the embodiments, and various modifications may be made without departing from the scope of the invention.

Moreover, in the embodiments, it is explained that the absorption member 12 is parallel to the nozzle rows, however, it is not necessary that the extension direction of the absorption member 12 and the extension direction of the nozzle row become complete parallel. That is, in the invention, the extension along the nozzle rows is not limited to the state in which the extension direction of absorption member 12 become complete parallel with the extension direction of the nozzle rows, it may be within the range that the absorption member 12 can receive ink droplets (fluid) during flushing. Further, the extension direction of the absorption member may be inclined to the nozzle rows during evacuating. Therefore, the moving amounts of the moving mechanism portion 14A and the moving mechanism portion 14B may be varied.

Moreover, in the embodiments, it is explained that the invention is applied to the line head type printer. However, the invention is not limited to this, and may be applied to a serial type printer.

Further, in the embodiments, it is explained that the absorption member 12 is always moved between the head and the recording paper (medium). However, in the invention, when evacuating the absorption member 12, the absorption member 12 may be moved to a region deviated from the direct bottom of the head (for example, the front side of the head).

Moreover, in the embodiments, the fluid ejecting apparatus of the invention is applied to the ink jet type printer. However, the fluid ejecting apparatus of the invention may be applied to the apparatuses in which fluid other than ink is ejected or discharged. That is, the fluid ejecting apparatus of the invention may be applied to various fluid ejection apparatuses including a fluid ejection head, and the like, which discharge minutely small liquid droplets. Further, the liquid droplet designates a fluid state discharged from the fluid ejecting apparatus, and may include granular, tear-shaped, threadlike trailed droplet. Also, the fluid may be any material ejected from the fluid ejecting apparatus.

For example, it is preferable if the material is a liquid phase, however, examples of the fluid may include as well as high or low viscosity liquid state, sol, gel water, other inorganic solvent, organic solvent, solution, liquid resin, fluid in flowable condition such as liquid metal (molten metal) or a state of material, and particles of functional material, which are dissolved, distributed or mixed, consisting of solid material such as pigments or metal particles, and the like. Further, as described in the embodiments, ink is mentioned as representative example of the fluid. Here, ink includes general water-based inks and oil-based inks, various fluid compositions such as gel inks, hot melt inks, and the like.

The fluid ejecting apparatus may include: for example, a fluid ejecting apparatus for ejecting fluids including materials such as electrode materials or color materials, which are used for manufacturing a liquid crystal display, EL (electroluminescence) display, a surface light emitting display, a color filter, and the like and are distributed or dissolved; a fluid ejecting apparatus for ejecting bioorganic materials used in the manufacture of bio chips; a fluid ejecting apparatus for ejecting fluids including samples used as a precision pipette; an apparatus for printing clothes; and a micro-dispenser, and the like.

Moreover, the fluid ejecting apparatus may include; a fluid ejecting apparatus for ejecting pin points of lubricating oil in precision machines such as watches or cameras; a fluid ejecting apparatus for ejecting transparent resins such as ultraviolet-curable resin, and the like for forming micro-hemispherical lens (optical lens) used in optical communication elements to the substrate, and the like; and a fluid ejecting apparatus for ejecting etching solutions of acid or alkaline, and the like for etching substrates, and the like.

What is claimed is:

1. A fluid ejecting apparatus comprising:

a fluid ejection head is provided with a nozzle row having a plurality of nozzles ejecting fluid;

a linear absorption member that is extended along the nozzle row and absorbs fluid ejected from the nozzle; and a traveling mechanism that causes the absorption member to travel from one side of the nozzle row toward the other side thereof, wherein the traveling mechanism includes, a delivery rotating body that drives out the absorption member from a state where the absorption member is wound up, a delivery driving portion that rotates the delivery rotating body, a winding-rotating body that winds up the absorption member that is driven out from the delivery rotating body, a winding-driving portion that rotates the winding-rotating body, a tension regulating member that applies a predetermined tension to the absorption member and is displaced according to the tension of the absorption member, and a sensor portion that detects the displacement of the tension regulating member and controls the delivery driving portion and/or the winding-driving portion so that the displacement of the tension regulating member is within a predetermined range.

2. The fluid ejecting apparatus according to claim 1, wherein the tension regulating member is constructed so that the tension regulating member reaches a first position if the absorption member is equal to or more than a first tension and is separated from the first position if the absorption member is less than the first tension, and the tension regulating member is constructed so that the tension regulating member reaches a second position if the absorption member is equal to or less than a second tension which is weaker than the first tension, and the sensor portion includes a first sensor that stops the winding-driving portion if the tension regulating member reaches the first position and drives the winding-driving portion if the tension regulating member is separated from the first position, and a second sensor that drives the winding-driving portion and stops the delivery driving portion if the tension regulating member reaches the second position.

3. The fluid ejection apparatus according to claim 2, wherein, in a state where the tension regulating member is displaced between the first position and the second position, the sensor portion is provided with a third sensor that detects a displacement amount displaced from a reference position and controls the delivery driving portion and/or the winding-driving portion.

4. The fluid ejecting apparatus according to claim 1, wherein the tension regulating member is installed in the delivery rotating body-side rather than the nozzle row, further comprising a rotating body for inspection in which the rotating body for inspection is turned accompanied by the rotating of the absorption member is provided along with rotating the absorption member in the course of a travel path of the absorption member that travels between the delivery rotating body and the tension regulating member, and a detection mechanism is provided in the rotating body for inspection, the detection mechanism detecting the traveling length of the absorption member which rotates the rotating body for inspection by detecting number of rotations of the rotating body for inspection.

5. The fluid ejecting apparatus according to claim 4, further comprising an identification body that is installed along the circumferential direction of the rotating body for inspection, wherein the detection mechanism detects the number of rotations of the rotating body for inspection by detecting the identification body.

6. The fluid ejecting apparatus according to claim 1, further comprising a safety mechanism that detects if the tension of the absorption member is equal to or more than a predetermined tension and stops the winding-driving portion.

7. The fluid ejecting apparatus according to claim 6, wherein the safety mechanism includes a safety lever that is displaced according to the tension of the absorption member and a safety sensor portion which detects when the safety lever is displaced and reaches a predetermined position by the tension of the absorption member becoming equal to or more than a predetermined tension and stops the winding-driving portion.

8. The fluid ejecting apparatus according to claim 1, wherein after the absorption member is moved from one side of the nozzle row toward the other side of the nozzle row, the absorption member is extended along a nozzle row different to the nozzle row along with rotating a reversal roller and again being directed to the first side.

9. The fluid ejecting apparatus according to claim 8, wherein the reversal roller is configured by a plurality of rollers in which intervals thereof are adjustable.

10. The fluid ejecting apparatus according to claim 1, wherein the absorption member is installed in plural, and the traveling mechanism is installed in plural according to the number of the absorption member.

11. The fluid ejecting apparatus according to claim 1, wherein the absorption member is extended along the nozzle row, and is relatively movable between the position at which the absorption member absorbs fluid ejected from the nozzle and the position at which the absorption member is removed from a flight path of fluid ejected from the nozzle.

* * * * *